United States Patent [19]

Kirillov et al.

[11] 4,014,674

[45] Mar. 29, 1977

[54] TURBOEXPANDER

[76] Inventors: Ivan Ivanovich Kirillov, ulitsa Politekhnicheskaya, 29, 2 korpus, kv. 67, Leningrad; Alexandr Petrovich Agishev, ulitsa Danilevskogo, 32a, kv. 14, Kharkov; Vladimir Nikolaevich Ameljushkin, ulitsa Dekabristov, 58/28, kv. 6, Leningrad; Sabir Yakubovich Bogdanovich, prospekt Lenina, 41/43, kv. 156, Knarkov; Chingiz Saibovich Guseinov, Krasnoshkolnaya naberezhnaya, 18, kv. 249, Kharkov; Valentin Valentinovich Medvedev, ulitsa Zernovaya, 53a, kv. 33, Kharkov; Igor Petrovich Faddeev, prospekt Raevskogo, 9, kv. 35; Viktor Sergeevich Rozin, ulitsa Korzuna, 5, kv. 204, both of Leningrad, all of U.S.S.R.

[22] Filed: Dec. 5, 1975

[21] Appl. No.: 638,053

Related U.S. Application Data

[63] Continuation of Ser. No. 543,545, Jan. 23, 1975, abandoned, which is a continuation of Ser. No. 445,791, Feb. 25, 1974, abandoned, which is a continuation of Ser. No. 292,837, Sept. 27, 1972, abandoned.

[52] U.S. Cl. ..... 62/38; 60/688; 55/442

[51] Int. Cl.[2] ..... F25J 3/06

[58] Field of Search ..... 60/688, 685, 689, 697; 62/38, 39, 40; 55/442

[56] References Cited

UNITED STATES PATENTS

| | | | |
|---|---|---|---|
| 873,041 | 12/1907 | Gray | 60/688 |
| 2,170,071 | 8/1939 | Furrer | 62/39 |
| 2,997,283 | 8/1961 | Seglem | 60/688 |

*Primary Examiner*—Norman Yudkoff
*Assistant Examiner*—J. Sofer
*Attorney, Agent, or Firm*—Holman & Stern

[57] ABSTRACT

A turboexpander preferably for cooling natural gas, comprising a casing whose shaft carries operating stages with blades. Provided in the casing in the direction of the gas-liquid flow is at least one separating stage wherein set in succession are a guiding device with a blade pitch smaller than that of corresponding blades of the operating stage, and a runner. The profile of the runner blades has an extended inlet portion with spouts provided on its back. Besides, there is a ring chamber provided in the casing along the periphery of the runner, said ring chamber having a slit for collection of the separated liquid and a branch pipe located in the lower part of the casing.

7 Claims, 11 Drawing Figures

TURBOEXPANDER

This is a continuation of application Ser. No. 543,545 filed Jan. 23, 1975 which in turn is a continuation of Ser. No. 445,791 filed Feb. 25, 1974, which in turn is a continuation of Ser. No. 292,837 filed Sept. 27, 1972 all of which are now abandoned.

The present invention relates to means for separation of liquid from natural or other gas and for cooling the latter, and, more particularly, to turboexpanders used in low-temperature gas-separation plants when preparing gas for long-distance transportation.

When preparing it for long-distance transportation, gas is subjected to cooling by way of being throttled from high pressure to pressure at an industrial collector in order to separate therefrom heavy hydrocarbons in the liquid state and water. The condensate and water emerged from the gas are separated in separators. For the recuperation of cold, prior to its throttling, natural gas is cooled in a heat exchanger by a flow of cold purified gas. This brings about a partial condensation of heavy hydrocarbons and water vapor, and the flow of the natural gas becomes two-phase. In the case of the gas reduced formation pressure, when the throttling fails to ensure its cooling down to a required temperature, use should be made of various cooling means. A turboexpander whose casing houses operating stages is one of such effective means used for artificial gas cooling.

In the turboexpander gas is cooled owing to expansion of a high-pressure gas flow, the operation taking place in one or several operating stages consisting of a guiding device and a runner. However, the efficiency of the turboexpander use (efficiency -economy, working capacity -blade erosion) depends upon the content of liquid inclusions and mechanical admixtures in the natural gas supplied into the turboexpander. Therefore, the gas supplied into the turboexpander must be subjected to purification. To raise the efficiency of gas mains operation, the gas should also be purified from the condensate settled in the turboexpander upon cooling.

Gravitational, louver, cyclone, and centrifugal separators are used presently for separation of liquid from gas.

A gravitational separator is fashioned as a vertical or horizontal vessel whose cross-sectional area is much larger than that of a pipeline carrying the gas flow containing liquid inclusions in the form of hydrocarbon condensate and water, i.e. a gas-liquid flow. In vertical separators, the gas-liquid flow is introduced at the side, and in horizontalalong the axle; the outlet being provided in both cases at the top. In the case of direct admission of the flow to vertical separator, its direction varies and speed decreases. Liquid drops that are of a greater specific weight fall down under gravity, and the purified gas flows to the collector via an upper branch pipe of the separator.

To increase the efficiency, some of the separators provide radial admission of the flow to the separator, with the resultant of eddying of the flow and separation of the liquid phase from the gas, taking place under the action of centrifugal forces.

The main prerequisite for the gravitational separation of liquid from gas is a low (smaller than 0.1 m/sec) gas flow rate; owing to which gravitational separators are rather bulky and consume much metal for their manufacture: their weight in the case of a daily rated output of 2 min normal $m^3$ or gas amounts to 31 tons; moreover, as it is impossible to separate finely-dispersed liquid drops that way, the efficiency of these separators is not higher than 80–85%.

In louver separators which are essentially bulky metal vessels arranged, as a rule, horizontally provision should be made for an attachment in the form of louver to increase the contact surface area and to settle down finely dispersed liquid drops. This helps raise their efficiency up to 85–90%, but the disadvantages typical of gravitational separators still remain.

Separators of similar types also used for purifying as outside the Soviet Union, as well.

Known in the art are cyclone separators (apparatuses of strictly limited modes of operation) whose efficiency drops forthwith, should any deviations from their rated output occur.

Of late, there have been developed mechanical centrifugal separators providing high efficiency of separation during some of the operating modes, requiring not much metal for their manufacture but needing a special drive.

Thus, all conventional separators are of a limited efficiency, consume too much metal for their manufacture, operate within strictly preset modes, and require a special drive.

It is an object of the present invention to eliminate the above disadvantages.

Another object of the invention is to provide a compact unit for purifying gas from liquid at the inlet to the operating stage of the turboexpander, for cooling gas when it expands within said stage, and for separation of the condensate emerged from the gas at the outlet of said stage.

The object of the invention is achieved by provision, on a common shaft of the turboexpander whose casing houses operating stages, in the direction of the gas flow, of at least one separating stage wherein set in succession are a guiding device with a blade pitch smaller than that of the corresponding blades of the operating stage and a runner whose blades profile has an extended inlet portion with spouts provided on its back; the casing has a ring chamber disposed, along the periphery of the runner and provided with a slit for collecting the separated liquid and an outlet branch pipe located in the lower part thereof, said branch pipe being fitted with a deflector.

It is advisable that the separating stage of such a type be provided at the inlet of the gas flow to the operating stages of the turboexpander, or at the outlet thereof, or both at the inlet and the outlet.

The shaft of the turboexpander may be made either integral of split, with the separating stages set, as consoles, on independent shafts.

It is also advisable to provide in the casing between the last operating stage and the guiding device of the separating stage a depression adapted to accommodate shaped annular inserts fitted with liquid catchers communicating with the ring chamber.

As a result of the embodiments described hereinabove, the turboexpander according to the present invention differs from other machines of the type, the differences consisting in the provision, within a single compact turbounit, of a device for cooling natural gas during its expansion and resultant work and for separating gas from liquid. In said device, use is made of Coriolis and centrifugal forces arising in the gas-and-liquid flow owing to the rotation of the runner in the separating stage, as a result of which a thermal drop is negligible if compared to that in the operating stage of the turboexpander. The separating stage does not need a special drive, requires little metal for its manufacture and boasts of high efficiency reaching 95–97%, within a wide range of operating modes.

Thus, with daily efficiency of the turboexpander being 2 mln normal $m^3$ of gas, the turboexpander with the separating stage weighs some 1 ton, its length being 1.4 m, the maximum diameter of the casing — 0.66 m, and the r.p.m. of the runner — some 10 thous.

When cooling the gas with an initial pressure of 56 atm and an initial temperature of 2°+5° C down to −10° C, the thermal drop in the operating stage of the turboexpander will be some 8 kcal/kg and not more than 1 kcal/kg in the separating stage.

A characteristic feature of the turboexpander lies in the provision of the split shaft therein; besides, the runner of the separating stage set as a console on a separate shaft may operate in an independent mode, which helps attain a lower peripheral speed (around 20 to 30 m/sec) at high speeds of the runner and the turboexpander, and a further increase the efficiency of purification of natural gas from liquid.

The present invention will be more apparent from the following description of exemplary embodiments, given with reference to the accompanying drawings, wherein.

Figure 1:
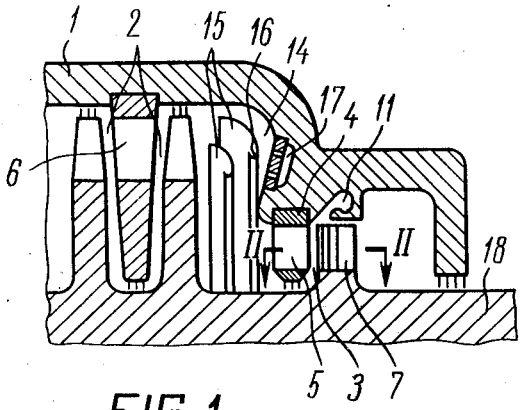
FIG. 1 is a longitudinal section of the turboexpander with the separating stage at the outlet of the gas flow from the last operating stages of the turboexpander, which are set on a common shaft.
Figure 2:
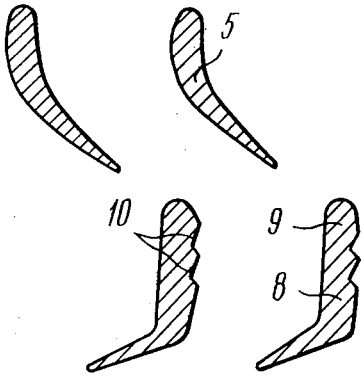
FIG. 2 is a section taken along line II—II in FIG. 1, showing the profiles of the separating stage blades.
Figure 3:
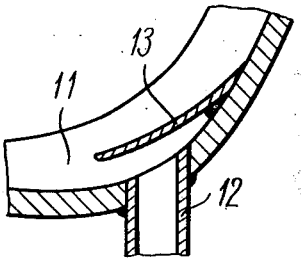
FIG. 3 is a lower portion of the ring chamber.
Figure 4:
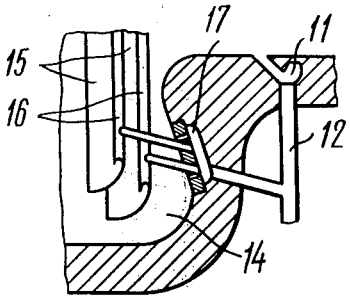
FIG. 4 is connection of the shaped annular inserts with the ring chamber.

The turboexpander (FIG. 1) comprises a casing 1 housing one or several operating stages 2. Provided at the outlet of the gas-liquid flow from the operating stages is a separating stage 3 wherein set in succession are a guiding device 4 with a pitch of blades 5 smaller than that of corresponding blades 6 of the operating stage, and a runner 7 the profile of whose blades 8 (FIG. 2) has an extended inlet portion 9 having spouts 10 provided on its back. In the casing 1 there is a ring chamber 11 (FIG. 3) disposed along the periphery of the runner 7, said ring chamber having a split for collecting the separated liquid and a branch pipe 12 fitted with a deflector 13 and disposed in the lower part thereof. Besides, for preliminary separation of the liquid phase, provided in the casing 1 between the last operating stage 2 and the guiding device 4 of the separating stage 3 is a depression 14 (FIGS. 1 and 2) accommodating shaped annular inserts 15 with liquid catchers 16 communicating with a slit discharged means 17 (FIGS. 1a and 4).

The runners of the operating stages 2 (FIG. 1) of the turboexpander are set on a shaft 18 common with the runner 7 of the separating stage.

The turboexpander functions as follows:

The natural gas flow passes through the operating stages 2 of the turboexpander (pressure stages or speed stages), wherein the gas, upon expansion, does the work and is cooled to lower temperatures, heavy hydrocarbons and vapours of water getting condensed and separated in the liquid state from the natural gas. The condensate having the form of small drops and films is carried away by the flow. After passing through the flow portion of the operating stages 2, the two-phase flow gets into the depression made in the casing 1 of the turboexpander, wherein it is partially purified from the liquid phase which is settled on the annular inserts 15 and on the walls of a chamber confined by the depression 14. This portion of the liquid accumulates in the slit discharge means 17 to be discharged therefrom into a condensate collector (not shown in the drawing) through a branch pipe. Then, the flow is delivered to the separating stage 3. In the guiding device 4 the flow is eddied and forced into the runner 7.

As the flow rates of the liquid drops are lower than those of the gas flow, the liquid drops are fed onto the moving blades 8 in a relative motion with a negative angle of attack, strike against the front convex portion of the moving blade 8 and settle down as a film on its surface. The liquid accumulated in the spouts 10 is pressed by Coriolis forces against the surface of the blade 8, moves toward the periphery of the runner 7 under the action of centrifugal forces, is thrown off the blades 8 and picked up by the ring chamber 11 wherefrom it is piped into the condensate collector via the branch pipe 12.

Figure 5:
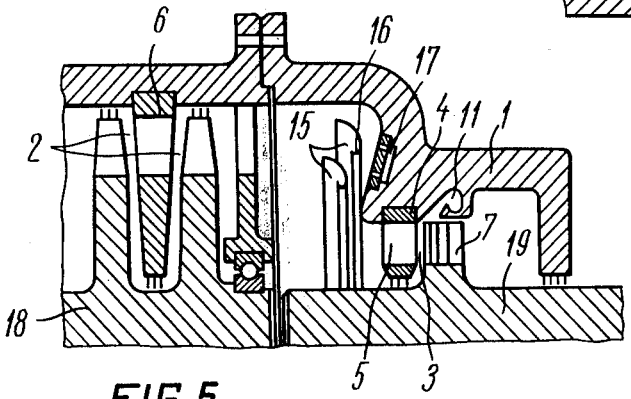
FIG. 5 is the turboexpander shown in FIG. 1 and having a split shaft.

The turboexpander shown in FIG. 5 is fashioned similarly to that in FIG. 1, the only difference being that it has a split shaft 18. The runner 7 of the separating stage 3 is set as console on a separate shaft 19.

Figure 6:
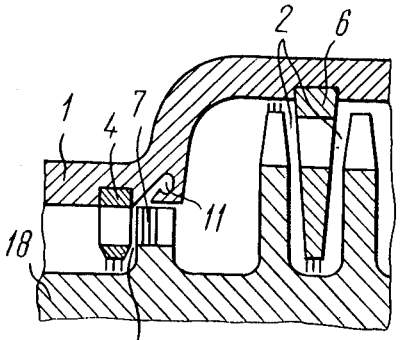
FIG. 6 is a turboexpander with the separating stage at the inlet of the gas-liquid flow to the operating stages of the turboexpander and the common shaft.

The turboexpander as shown in FIG. 6 comprises a casing 1 accommodating operating stages 2. Provided at the inlet of the gas-liquid flow to the first operating stage is a separating stage 20 wherein set in succession are a guiding device 4 with a pitch of blades 5 which is smaller than that of corresponding blades 6 of the operating stage, and a runner 7 the profile of blades 8 of which has an extended inlet portion 9 with spouts 10 provided on its back. A ring chamber 11 with a slit for collecting the separated liquid and a branch pipe 12 (FIG. 3) located in the lower part thereof, which is fitted with a deflector 13, is provided in the casing 1 along the periphery thereof.

The runners of the turboexpander and of the separating stage 20 are set on a common shaft 18.

In the turboexpander (FIG. 6) the two-phase flow of natural gas, goes, first, to the separating stage 20 wherein it is separated from liquid by a method described hereabove and, then, is cooled in the operating stages 2 of the turboexpander. The separating stage 20 thus arranged increases the efficiency and the service life of the turboexpander by way of purifying the gas flow at the inlet.

Figure 7:
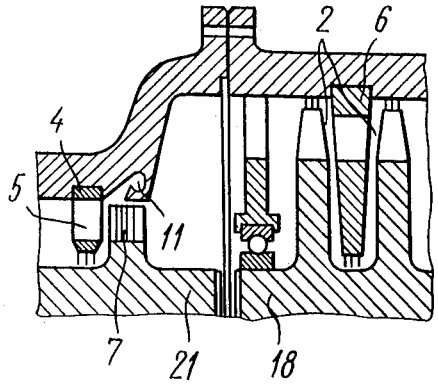
FIG. 7 is the turboexpander shown in FIG. 6 and having a split shaft.

The turboexpander as shown in FIG. 7 is fashioned similarly to the turboexpander of FIG. 6 but has a split shaft 18 and the runner 7 of the separating stage 20 set as console on a separate shaft 21.

Figure 8:
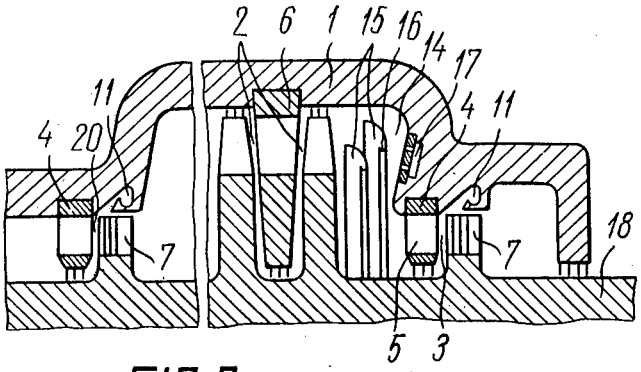
FIG. 8 is a turboexpander with the separating stages at the inlet of the gas-liquid flow to the operating stages and at the outlet therefrom, set on the common shaft.

The turboexpander shown in FIG. 8 comprises a casing 1 housing operating stages 2. Provided at the inlet of the gas-liquid flow to the first operating stage is a separating stage 20 and a ring chamber 11 which are similar to those in the turboexpander of FIG. 6, while at the outlet of the last operating stage 2 there is a separating stage 3, a ring chamber 3 and shaped annular inserts 15 similar to those in the turboexpander of FIG. 1. The runners 7 of the inlet separating stage 20, the operating stages 2 of the turboexpander and the outlet separating stages 3 are set on a common shaft 18.

In the turboexpander as shown in FIG. 8, the flow of natural gas goes, first, to the separating stage 20, is separated from liquid, cooled in the operating stages 2 of the turboexpander and, then, purified from the liquid phase settled as a result of gas cooling in the outlet separating stage 3 by way of method described hereinabove.

Figure 9:
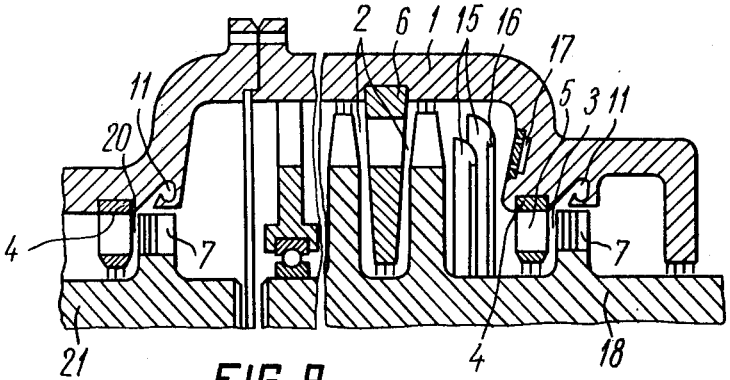
FIG. 9 is the turboexpander shown in FIG. 8 and having a split shaft and the runner of the inlet separating stage, which is set as a console on a separate shaft.

The turboexpander as shown in FIG. 9 is made similarly to the turboexpander of FIG. 8, the only difference being that it has a slit shaft. The runner 7 of the inlet separating stage 20 is set as console on a separate shaft 21, while the runners of the operating stages 2 and of the outlet separating stage 3 are set on a common shaft 18.

Figure 10:
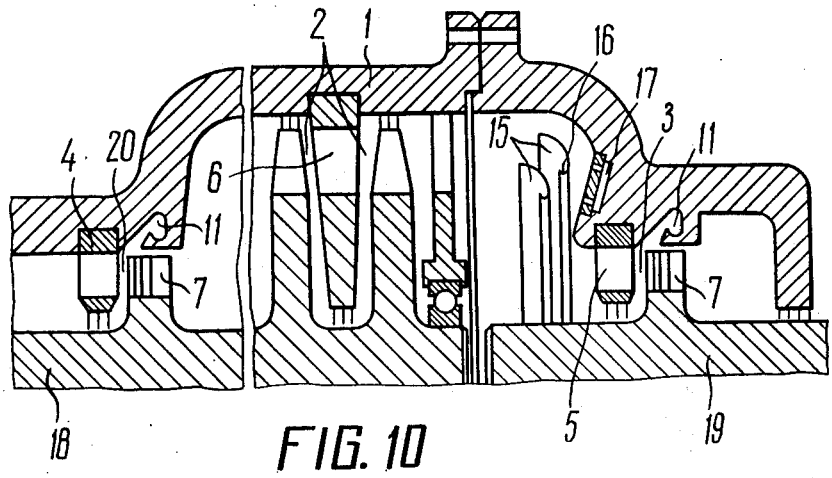
FIG. 10 is the turboexpander shown in FIG. 8 and having a split shaft and the runner of the outlet separating stage, which is set as a console on a separate shaft.

The turboexpander shown in FIG. 10 is similar to the turboexpander of FIG. 8, the only difference being that it has a split shaft, the runners 7 of the inlet separating stage 20 and of the operating stages 2 of the turboexpander being set on a common shaft 18 and the runner 7 of the outlet separating stage 3 being set as console on a separate shaft 19.

Figure 11:
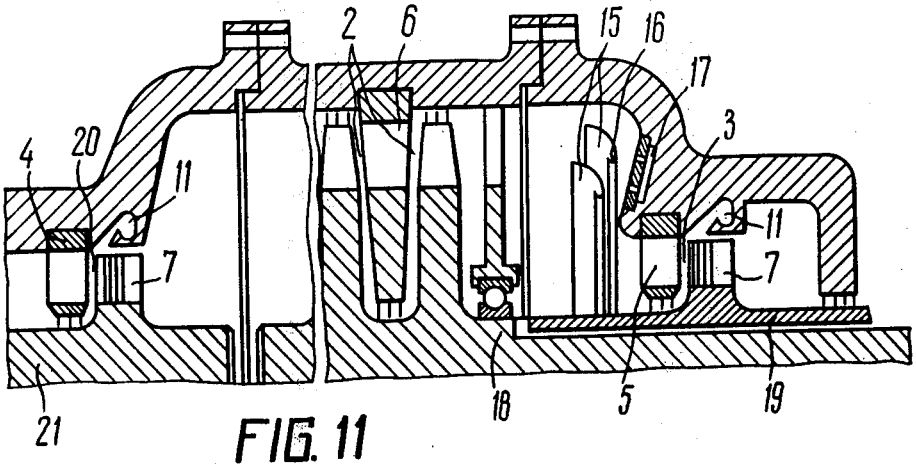
FIG. 11 is the turboexpander shown in FIG. 8 having a split shaft and the runners of the inlet and outlet separating stages, which are set on separate shafts.

The turboexpander as shown in FIG. 11 is similar to the turboexpander of FIG. 8, the only difference being that it has a split shaft. The runner 7 of the inlet separating stage 20 is set as console on a separate shaft 21, the runners of the operating stages 2 of the turboexpander being arranged on a separate shaft 18 and the runner 7 of the outlet separating stage 3 being set as console also on a separate shaft 19. The pick-up of power from the turboexpander is effected from the shaft 18 provided inside the hollow shaft 19.

In the turboexpander (FIGS. 5, 7, 9, 10 and 11), the separating stages purifying, as described hereinabove, natural gas from liquid incoming to the turboexpander or settled therefrom upon cooling may have independent operating modes owing to provision of a split shaft; as a result, their peripheral speeds are lower as the speeds of the runners of the turboexpander stages are high, which cannot but raise the efficiency of the natural gas separation and help match the operating modes of the separating stage and on the turboexpander.

We claim:

1. A turboexpander preferably for cooling natural gas, comprising a casing set on a shaft; at least one operating stage with blades, which is arranged on the shaft in said casing; at least one separating stage arranged on the shaft in said casing in the direction of the gas-liquid flow; a guiding device with blades, which is provided in said separating stage, the blade pitch being smaller than that of said operating stage; a runner arranged in succession with said guiding device in said separating stage, the profile of the blades of said guiding device having an extended inlet portion; said inlet portion of the blade having spouts provided on its back; said casing being provided with a ring chamber disposed along the periphery of said runner, said ring chamber having a slit for collection of the separated liquid and a branch pipe located in the lower part of said casing.

2. A turboexpander as claimed in claim 1, wherein said separating stage is arranged at the inlet of the gas-liquid flow to said operating stages of the turboexpander, thus ensuring purification of the flow from liquid and protecting the runners blades against erosion.

3. A turboexpander as claimed in claim 1, wherein said separating stage is arranged at the outlet of the gas-liquid flow from the operating stages of the turboexpander, thus ensuring purification of the flow from liquid and raising the efficiency of gas transportation.

4. A turboexpander as claimed in claim 1, wherein said separating stage is arranged at the input of the gas-liquid flow to said operating stages and at the outlet from its operating stages.

5. A turboexpander preferably for cooling natural gas, comprising a casing set on a shaft; at least one operating stage with blades, said stage being arranged on the shaft in said casing; at least one separating stage arranged on the shaft in said casing in the direction of the gas-liquid flow; a guiding device with blades, which is provided in said separating stage, the blade pitch being smaller than that of said operating stage; a runner provided in succession with said guiding device in said separating stage, the profile of the blades of said runner being extended in its inlet portion; said inlet portion of the blade having spouts provided on its back; in said casing, there is a ring chamber provided along the periphery of said runner, said chamber having a slit for collection of the separated liquid and a branch pipe in the lower part of said casing; said shaft made split and said runner of at least one separating stage being set as console on a separate shaft coaxial with said shaft.

6. A turboexpander as claimed in claim 5, wherein said branch pipe in the lower portion of said ring chamber has a deflector.

7. A turboexpander as claimed in claim 5, wherein there is a depression between the last said operating stage of the turboexpander and said separating stage, said depression accommodating shaped annular inserts with liquid catchers communicating with said ring chamber.

* * * * *